US009422786B2

(12) United States Patent
Yokley et al.

(10) Patent No.: US 9,422,786 B2
(45) Date of Patent: Aug. 23, 2016

(54) HYBRID-TIEBACK SEAL ASSEMBLY

(71) Applicant: Dril-Quip, Inc., Houston, TX (US)

(72) Inventors: John M. Yokley, Kingwood, TX (US); Curtis W. Payne, Richmond, TX (US)

(73) Assignee: Dril-Quip, Inc., Houston, TX (US)

( * ) Notice: Subject to any disclaimer, the term of this patent is extended or adjusted under 35 U.S.C. 154(b) by 389 days.

(21) Appl. No.: 13/888,869

(22) Filed: May 7, 2013

(65) Prior Publication Data

US 2013/0299176 A1 Nov. 14, 2013

Related U.S. Application Data

(60) Provisional application No. 61/644,168, filed on May 8, 2012.

(51) Int. Cl.

| | |
|---|---|
| ***E21B 33/043*** | (2006.01) |
| ***E21B 43/10*** | (2006.01) |
| ***E21B 23/01*** | (2006.01) |
| ***E21B 19/00*** | (2006.01) |
| ***E21B 33/12*** | (2006.01) |
| ***E21B 33/04*** | (2006.01) |

(52) U.S. Cl.

CPC ..... *E21B 33/1208* (2013.01); *E21B 33/04* (2013.01); *E21B 33/1212* (2013.01); *E21B 43/10* (2013.01)

(58) Field of Classification Search

None

See application file for complete search history.

(56) References Cited

U.S. PATENT DOCUMENTS 7,861,789 B2 * 1/2011 Nelson ..... E21B 33/043 166/196
2012/0222861 A1 * 9/2012 Eriksen ..... E21B 7/20 166/290

FOREIGN PATENT DOCUMENTS

EP 0515742 A1 12/1992

OTHER PUBLICATIONS

Search Report issued in corresponding Great Britain Patent Application No. GB1308172.4, mailed Oct. 25, 2013, 3 pages.

* cited by examiner

*Primary Examiner* — Matthew R Buck
*Assistant Examiner* — Douglas S Wood
(74) *Attorney, Agent, or Firm* — Baker Botts L.L.P.

(57) ABSTRACT

A hybrid-tieback seal assembly and methods for tying a well back to the surface or subsea well head are disclosed. A method to tie a well back to the surface or subsea well head comprises running a hybrid-tieback seal assembly into a wellbore, the hybrid-tieback seal assembly comprising one or more anchoring bodies, one or more packer seal assemblies; and a device for creating a pressure differential in a tieback string, wherein the tieback string is coupled to the hybrid-tieback seal assembly. The method further comprises landing a casing hanger in a well head, increasing pressure in the tieback string, setting the anchoring bodies and one or more packer seal assemblies within at least one of a previously installed liner hanger system and a host casing above a previously installed hanger system, and testing the hybrid-tieback seal assembly down an annulus between the host casing and the tieback string.

18 Claims, 9 Drawing Sheets

HYBRID-TIEBACK SEAL ASSEMBLY

CROSS-REFERENCE TO RELATED APPLICATION

This application claims priority to U.S. Provisional Patent Application Ser. No. 61/644,168 filed May 8, 2012, which is incorporated herein by reference.

BACKGROUND

The present invention relates generally to tieback assemblies and, more particularly, to hybrid-tieback seal assemblies and associated methods of tying a well back to the surface or subsea well head.

Current methods used to tie a well back to the surface or subsea well head from an existing downhole liner hanger employ running a tieback string into the well. These tieback strings typically have seals at their bottom end that stab into a tieback receptacle or polished bore receptacle of an existing downhole liner hanger. This typical approach may be problematic due to the small space out window (i.e., length of space available to stab into the tieback receptacle), which is typically dictated by the length of the tieback receptacle. This typical approach may also be problematic in applications where the existing liner hanger is one that is very thin and as a result has a very low collapse value. When attempting typical tieback methods with thin liner hanger systems, there is a risk of collapsing the tieback receptacle, liner top, and/or tieback string. These thin liner hanger systems typically include, but are not limited to, the following sizes: 7⅝×9⅝, 9⅝×11¾, 11¾×13⅝, and 13⅝×16. As a result, a new and improved method of tying a well back to the surface or subsea well head is desirable.

BRIEF DESCRIPTION OF THE DRAWINGS

Some specific exemplary embodiments of the disclosure may be understood by referring, in part, to the following description and the accompanying drawings.

Figure 1A:
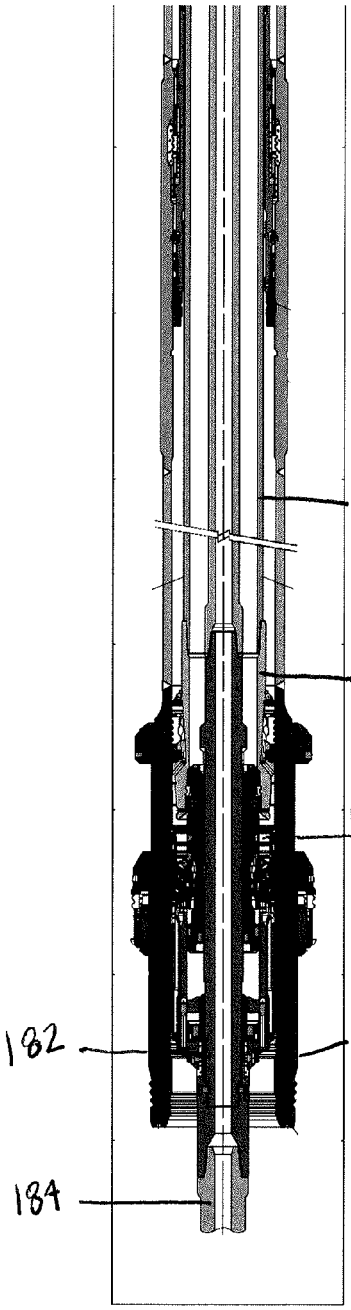
FIGS. 1A-1C depict a liner hanger system and a Hybrid-Tieback Seal Assembly (HTSA) in accordance with an illustrative embodiment of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present invention relates generally to tieback assemblies and, more particularly, to hybrid-tieback seal assemblies and associated methods of tying a well back to the surface or subsea well head.

The terms "couple" or "couples" as used herein are intended to mean either an indirect or direct connection. Thus, if a first device couples to a second device, that connection may be through a direct connection, or through an indirect mechanical or electrical connection via other devices and connections. Similarly, the term "fluidically coupled" as used herein is intended to mean that there is either a direct or an indirect fluid flow path between two components. The term "uphole" as used herein means along the drillstring or the hole from the distal end towards the surface, and "downhole" as used herein means along the drillstring or the hole from the surface towards the distal end.

The present disclosure is directed to a system where a tieback string is set and sealed in an existing downhole liner hanger system, or into the host casing above the downhole liner hanger system. Setting and sealing the tieback string in the host casing above the liner hanger system may allow for the tieback receptacle or liner top of the liner hanger system to be isolated so it remains pressure balanced and has no risk of collapse. This system may incorporate the slips, sealing technologies, and other disclosures found in U.S. Pat. Nos. 6,761,221 and 6,666,276, the entireties of which are hereby incorporated by reference. This system may also be used with any well head system.

Illustrative embodiments of the present invention are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time consuming, but would nevertheless be a routine undertaking for those of ordinary skill in the art having the benefit of the present disclosure.

To facilitate a better understanding of the present invention, the following examples of certain embodiments are given. In no way should the following examples be read to limit, or define, the scope of the invention. Embodiments of the present disclosure may be used with any well head system. Embodiments of the present disclosure may be applicable to horizontal, vertical, deviated, or otherwise nonlinear wellbores in any type of subterranean formation. Embodiments may be applicable to injection wells as well as production wells, including hydrocarbon wells.

In certain embodiments, the present disclosure provides a method to tie a well back to the surface or subsea well head using a Hybrid-Tieback Seal Assembly (HTSA). In one embodiment, the tieback string is allowed to fill with fluid while running into the hole. In another embodiment, the present disclosure provides a method where pressure is allowed to build from the surface in the tieback string to actuate downhole devices. In certain embodiments, a device may be used to create a pressure differential in the tieback string. In one illustrative embodiment, the use of an inverted float collar may allow for fluid to enter the tieback string while being run into the hole. Once the tieback string is pressurized, the valve in the collar may close so that pressure may be increased in the tieback string to set slips and seals. In other embodiments, a downhole ball seat in the tieback string may be used and a ball may be dropped from the surface when it is desirable to set the HTSA. In this embodiment, when the ball is dropped from the surface and lands on the ball seat, it may act as a pressure barrier providing a pressure differential. Although certain exemplary devices are disclosed as suitable for use in creating a pressure differential in the tieback string, as would be appreciated by those of ordinary skill in the art having the benefit of the present disclosure, any other suitable device (e.g., plugs) may be used to create a pressure differential in the tieback string without departing from the scope of the present disclosure.

In certain embodiments, the methods discussed herein may incorporate slips that are independently hydraulically set and locked. These slips may be used to lock the tieback string from any movement up or down that could damage the seal between the tieback string and the host casing. In certain embodiments, the slips may be one piece or multiple pieces. In other embodiments, the methods discussed herein may incorporate the use of a metal to metal packer seal which may be hydraulically set.

Figure 1B:
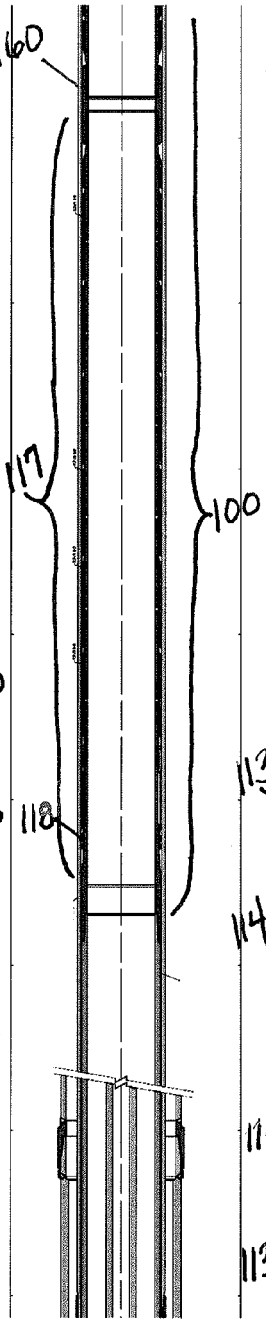
Figure 1C:
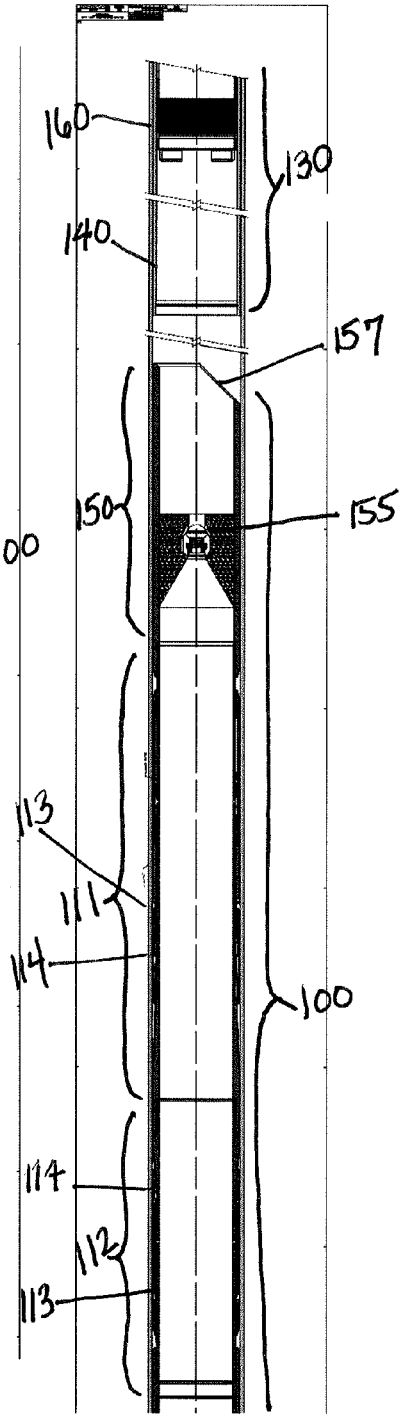

Referring now to the Figures, FIGS. 1A-1C depict a Hybrid-Tieback Seal Assembly (HTSA), denoted generally with reference numeral 100, and a downhole liner hanger system, denoted generally with reference numeral 130, in accordance with an illustrative embodiment of the present disclosure. FIGS. 1A-1C show the HTSA 100 as it extends from one distal end to another.

In this illustrative embodiment, the liner hanger system 130 may be run and set in a wellbore (not shown). The liner hanger system 130 may be disposed within a host casing 160. The liner hanger system 130 may comprise, but is not limited to, a packer seal, a running adapter, a hanger body, a slip, a packer cone, a pusher sleeve, a lock ring, a liner top and/or a receptacle 140. In certain implementations, the receptacle 140 may include, but is not limited to, a tieback receptacle (TBR) or polished bore receptacle (PBR). Although certain components of the liner hanger system 130 are discussed for illustrative purposes, it would be appreciated by those of ordinary skill in the art, having the benefit of the present disclosure, that one or more components may be removed, modified, or added without departing from the scope of the present disclosure.

In certain embodiments in accordance with the present disclosures, the HTSA 100 may be set in the liner hanger system 130. In other embodiments, the HTSA 100 may be set in the hosting casing 160, positioned above the liner hanger system 130. In the illustrative embodiment shown in FIGS. 1A-1C, the HTSA 100 is set in the host casing 160, positioned above the liner hanger system 130. The HTSA 100 may be coupled to a tieback string 101. The HTSA 100 may comprise one or more anchoring bodies, which may be hydraulically or mechanically set. In certain embodiments in accordance with the present disclosure, the one or more anchoring bodies may include a hold up body 111 and a hold down body 112, which may be hydraulically or mechanically set. The hold up and hold down bodies 111, 112 may include a pusher sleeve 113 having an anti-backlash system to prevent movement and one or more single direction or bi-directional slips 114, which may be independently set. The hold up and hold down bodies 111, 112 also may include a locking device (not shown), such as a lock ring, snap ring, collet, wedge or segmented slip system, and a shear pin. The slips 114 may be one piece or multiple pieces. Although certain components of the anchoring bodies 111, 112 are discussed for illustrative purposes, it would be appreciated by those of ordinary skill in the art, having the benefit of the present disclosure, that one or more components may be removed or modified without departing from the scope of the present disclosure. The HTSA 100 may incorporate any suitable slip mechanisms including, but not limited to, slip mechanisms disclosed in U.S. Pat. No. 6,761,221, the entirety of which has been incorporated by reference into the present disclosure.

The HTSA 100 may also comprise one or more metal to metal packer seal assemblies 117 which may be hydraulically or mechanically set. The packer seal assembly 117 may include a packer seal 118. The packer seal assembly may also include, but is not limited to, a packer body, a pusher sleeve, a lock ring, a shear pin, a locking assembly, and/or a lock body. Although certain components of the packer seal assembly 117 are discussed for illustrative purposes, it would be appreciated by those of ordinary skill in the art, having the benefit of the present disclosure, that one or more components may be removed, modified, or added without departing from the scope of the present disclosure. The HTSA 100 may incorporate sealing technology disclosed in U.S. Pat. No. 6,666,276, the entirety of which has been incorporated by reference into the present disclosure.

In certain embodiments, the HTSA 100 may also comprise a device for creating a pressure differential in the tieback string 101. In the illustrative embodiment shown in FIGS. 1A-1C, the HTSA 100 comprises an inverted float collar 150. The inverted float collar 150 may further comprise a valve 155 and a mule shoe or wireline entry guide 157. The inverted float collar 150 may allow fluid to enter the tieback string 101 while the HTSA 100 is being run into the hole. The valve 155 in the inverted float collar 150 may close when the tieback string 101 is pressured down from the surface so that pressure may be increased in the tieback string 101 to set the anchoring bodies 111, 112 and/or packer seal assembly 117.

In certain embodiments in accordance with the present disclosure, the HTSA 100 may be run into the wellbore (not shown) and landed in the well head 170 and set above the receptacle 140 of the liner hanger system 130, within the host casing 160. In this manner, the HTSA 100 may protect the host casing 160 above the liner hanger system 130 and may provide zonal isolation up to the surface or subsea well head. The HTSA 100 also may protect the inner diameter of the tieback string 101 from pressure located between the tieback string 101 and the host casing 160.

Figure 2:
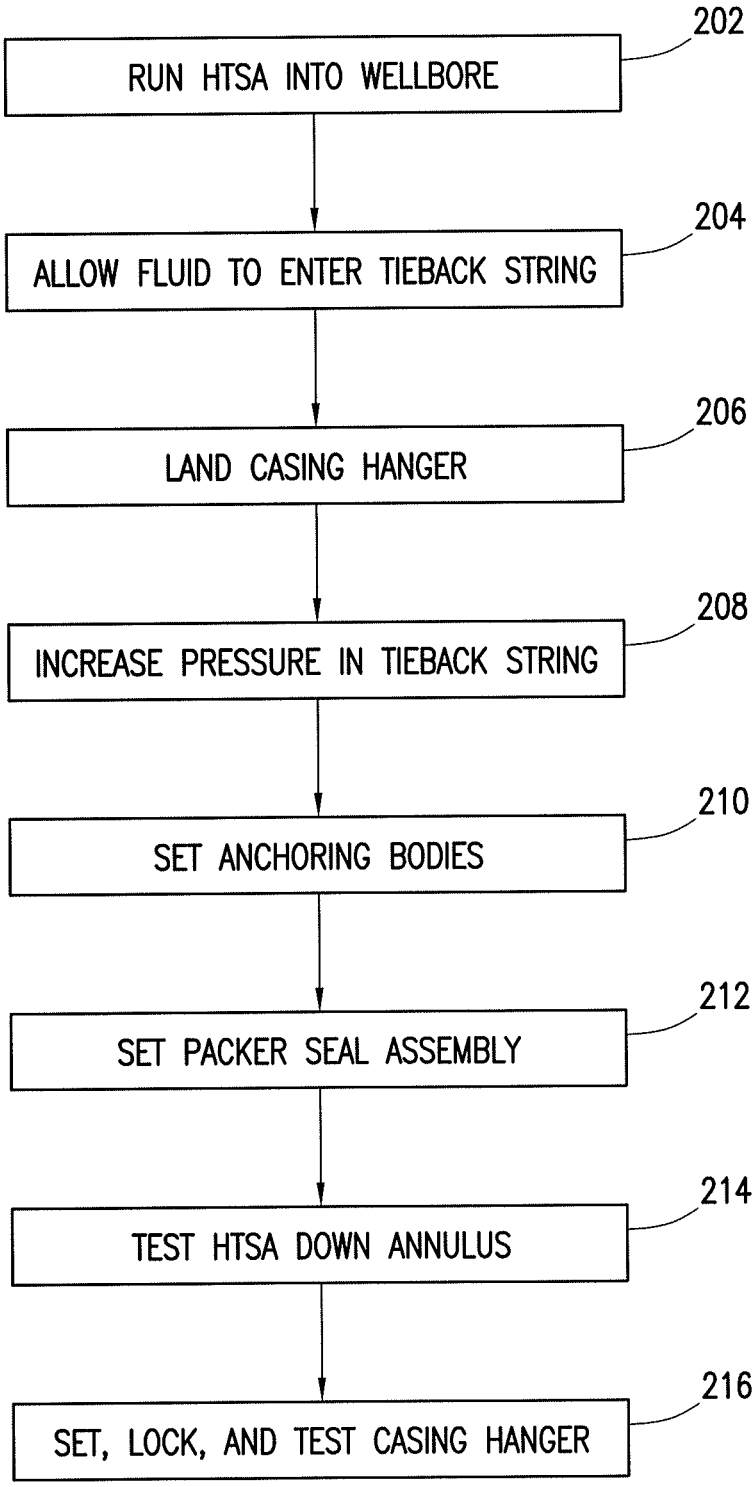
FIG. 2 is a flowchart depicting a method of tying a well back to the surface or subsea well head using the HTSA of FIG. 1, in accordance with an illustrative embodiment of the present disclosure.

Operation of the HTSA 100 in accordance with the illustrative embodiment of FIGS. 1A-1C will now be discussed in conjunction with FIG. 2. FIG. 2 is a flowchart depicting illustrative method steps associated with a method to tie a well back to the surface or subsea well head using the HTSA 100 of FIG. 1, in accordance with an illustrative embodiment of the present disclosure. Although a number of steps are depicted in FIG. 2, as would be appreciated by those of ordinary skill in the art, having the benefit of the present disclosure, one or more of the recited steps may be eliminated, modified, or added without departing from the scope of the present disclosure.

First, at step 202, the HTSA 100 is run into a wellbore (not shown). At step 204, the inverted float collar 150 allows fluid to enter the tieback string 101 while the HTSA 100 is being run into the wellbore (not shown). At step 206, the casing hanger 180 is landed in the well head 170. As a result of landing the casing hanger 180 in the well head 170, the HTSA 100 is located within the host casing 160, above the liner hanger system 130. At step 208, tieback string 101 is pressured down from the surface and the valve 155 in the inverted float collar 150 closes to increase the pressure in the tieback string 101 to set the slips 114 and packer seal assembly 117. At step 210, the anchoring bodies 111, 112 of the HTSA 100 may be set within the host casing 160, thus anchoring the HTSA 100 within the host casing 160. The slips 114 of the anchoring bodies 111, 112 may be used to isolate the HTSA 100 from movement. The locking device of the anchoring bodies 111, 112 may retain the mechanical load applied to the slips 114 of the anchoring bodies 111, 112. At step 212, the packer seal 118 may be mechanically or hydraulically set within the host casing 160, above the liner hanger system 130. In certain embodiments, the packer seal assembly 117 may be set last so the HTSA 100 may be fully anchored prior to setting. At step 214, the HTSA 100 may be tested down the annulus between the host casing 160 and the tieback string 101. At step 216, casing hanger 180 may be fully set, locked, and tested.

FIGS. 3A-11 depict a sequence of method steps associated with tying a well back to the surface or subsea well head using the HTSA 100 of FIG. 1, in accordance with certain embodiments of the present disclosure.

Figure 3A:
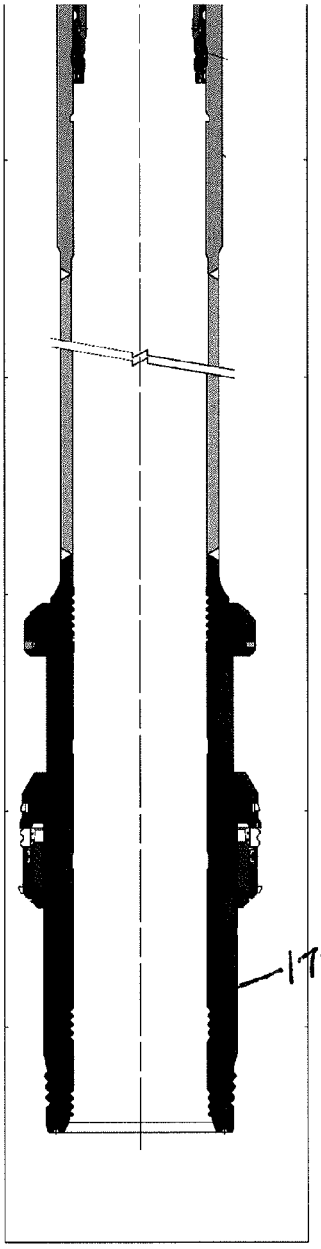
FIGS. 3A-11 depict a sequence of method steps associated with a hybrid-tieback seal assembly, in accordance with certain embodiments of the present disclosure.
Figure 3B:
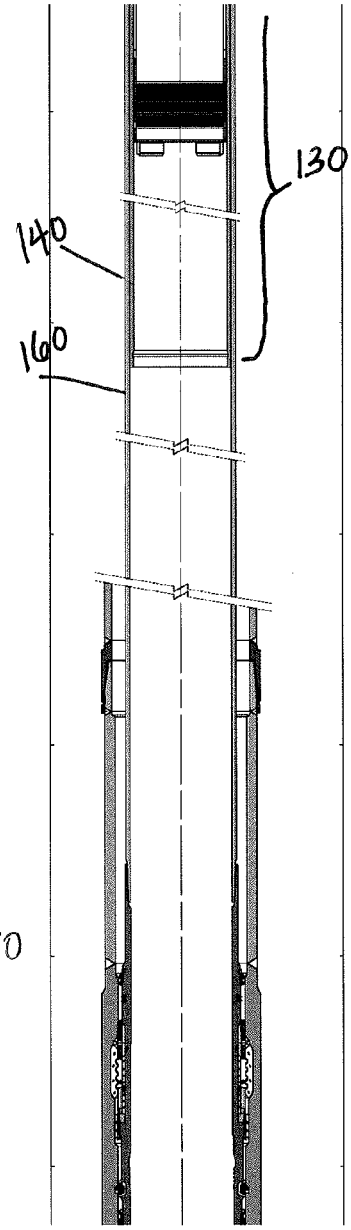
Figure 3C:
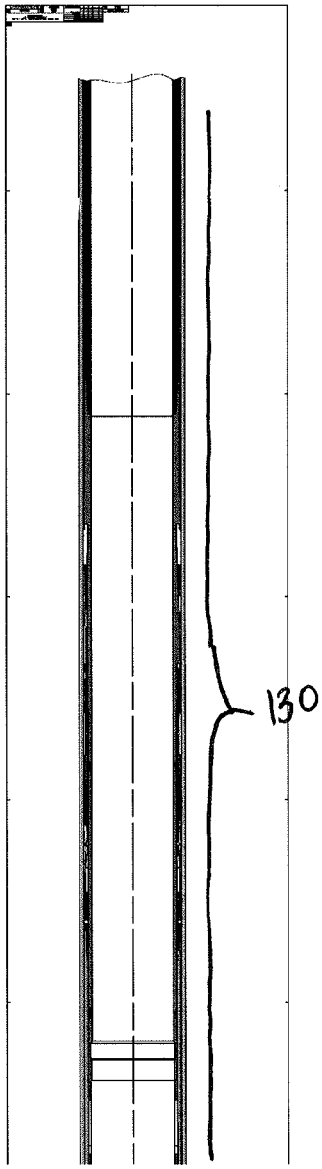

FIGS. 3A-3C illustrate how the liner hanger system 130 may be run into the host casing 160 below where the HTSA 100 is to be set. The host casing 160 may be run to desired depth and hung off in the well head 170. The liner hanger system 130 may then be run and set in the host casing 160.

Figures 4A, 4B, 4C:
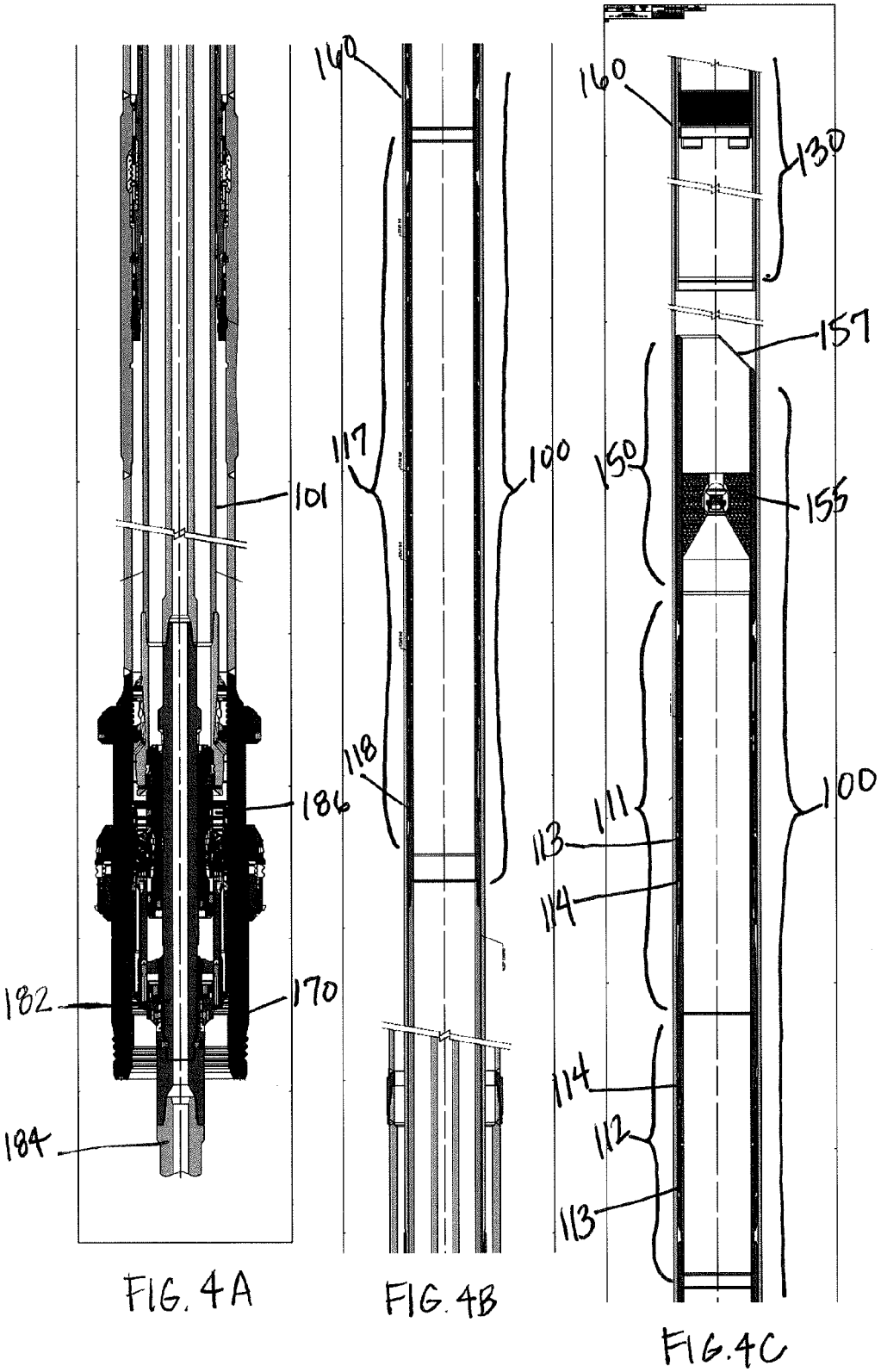

Referring now to FIGS. 4A-4C, FIGS. 4A-4C illustrate how the HTSA 100 may be run into the hole and positioned somewhere above the liner hanger system 130 as it is being landed into the well head 170. The HTSA 100 may comprise an inverted float collar 150, one or more anchoring bodies 111, 112 comprising slips 114, which are independently hydraulically set, and a metal to metal packer seal assembly 117, which is hydraulically set. The inverted float collar 150 may allow fluid to enter the tieback string 101 while it is being run into the hole, but when pressuring down the tieback string 101 from the surface, the valve 155 in the inverted float collar 150 may close so pressure may be increased in the tieback string 101 to set the slips 114 and packer seal 118 of the packer seal assembly 117. The tieback string 101 may be coupled to the HTSA 100 and run in hole. The casing hanger 180 may be coupled to a casing hanger running tool 182. A drill pipe 184 may be coupled to the casing hanger running tool 182 and continue to be run in hole. Finally, the HTSA 100 may be positioned somewhere above the previously run liner hanger system 130.

Figures 5A, 5B, 5C:
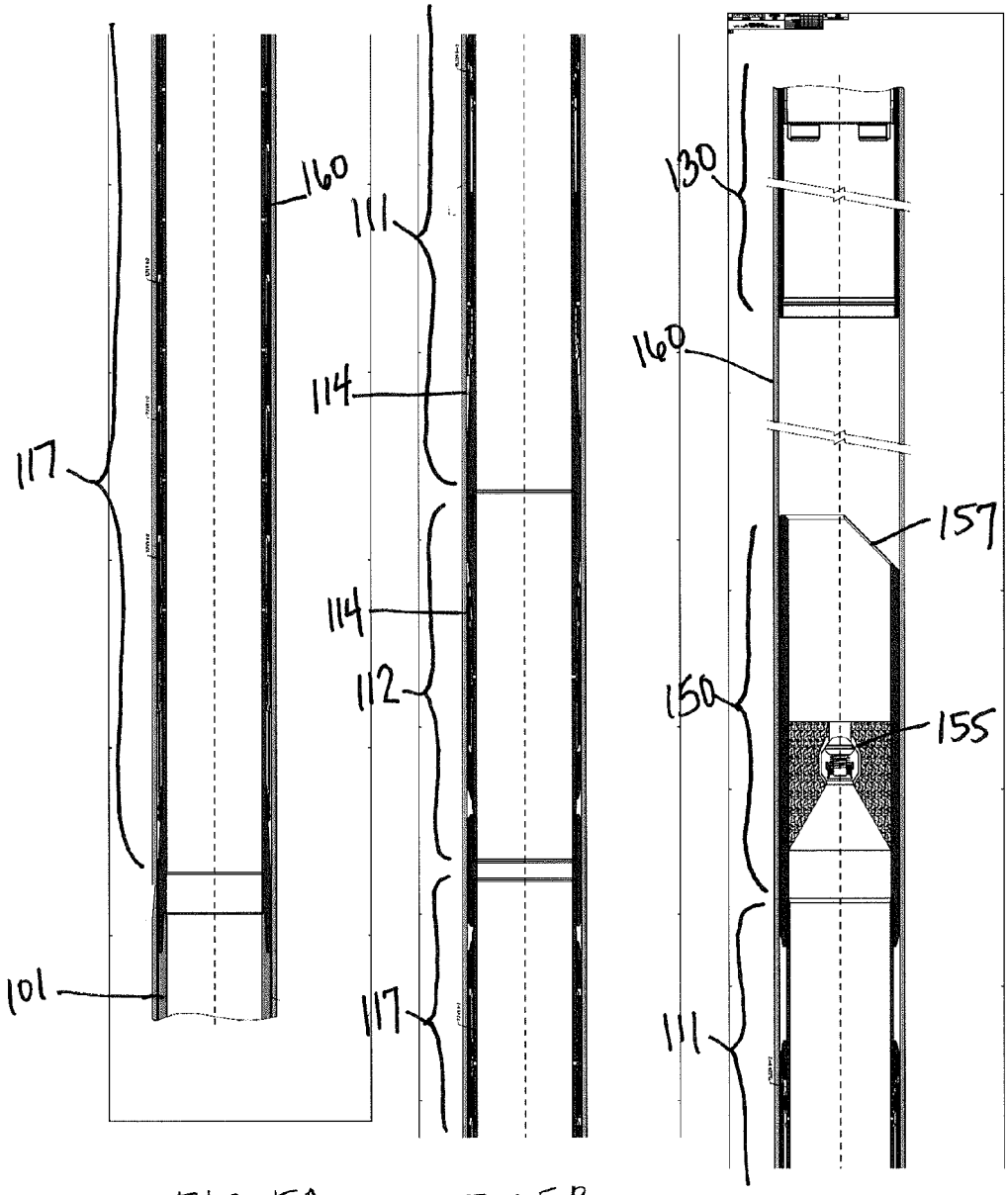

Referring now to FIGS. 5A-5C, FIGS. 5A-5C illustrate how the hold up body 111 of the HTSA 100 may be set. The casing hanger 180 can be landed into the well head 170. Weight from the tieback string 101 may then be slacked off onto the well head 170. In this method, the casing hanger seal 186 may not be set and the casing hanger lock ring 188 may not be locked. The tieback string 101 can then be pressurized to a set pressure, for example 1000 psi, to set the slip 114 of the hold up body 111. This sequence may keep the HTSA 100 from moving downhole.

Figures 6A, 6B, 6C:
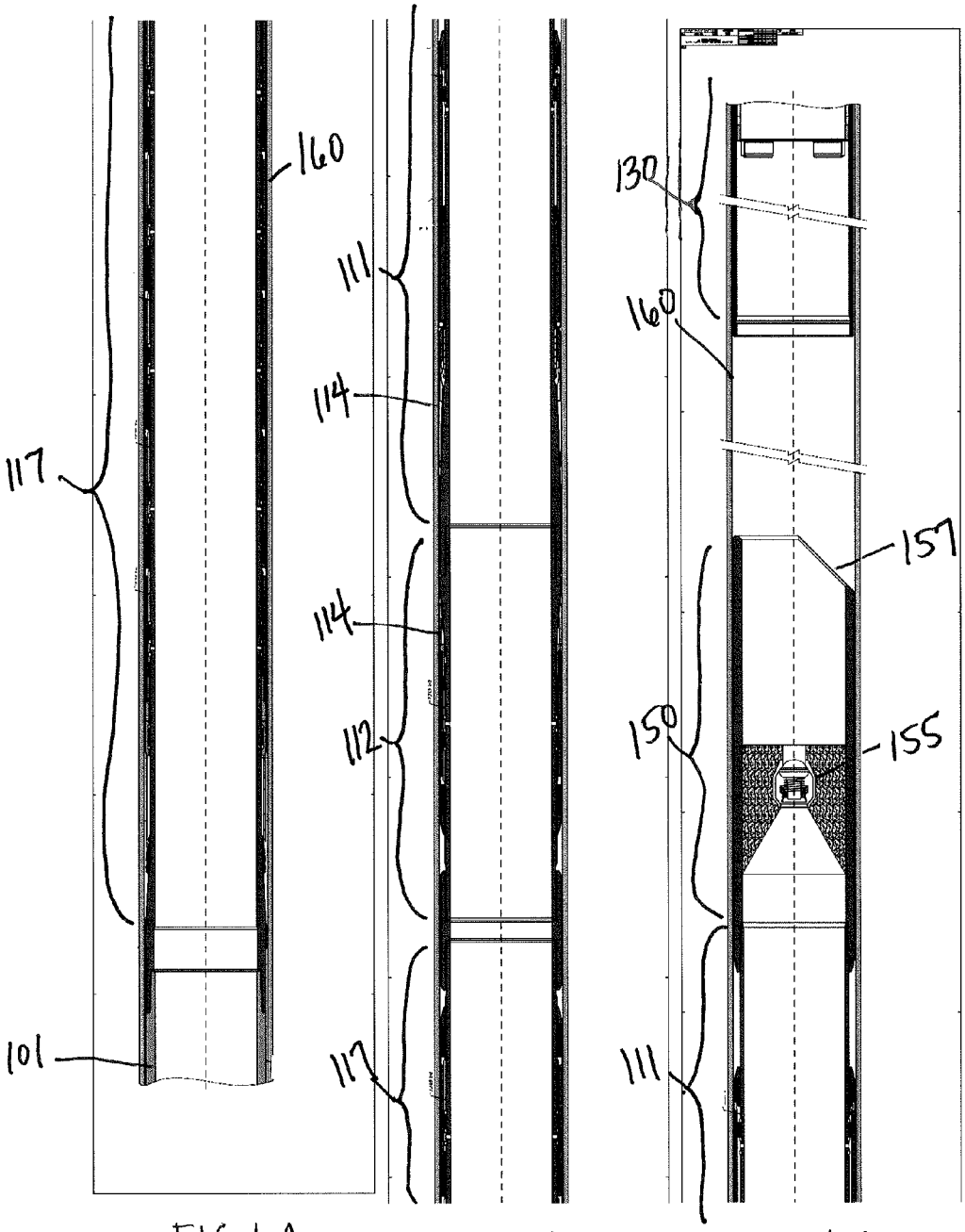

Referring now to FIGS. 6A-6C, FIGS. 6A-6C illustrate how the hold down body 112 may be set. The tieback string 101 may be pressurized to a set pressure, for example 2000 psi, to set the slip 114 of the hold down body 112. This sequence may keep the tieback string 101 from moving up the hole.

Figures 7A, 7B, 7C:
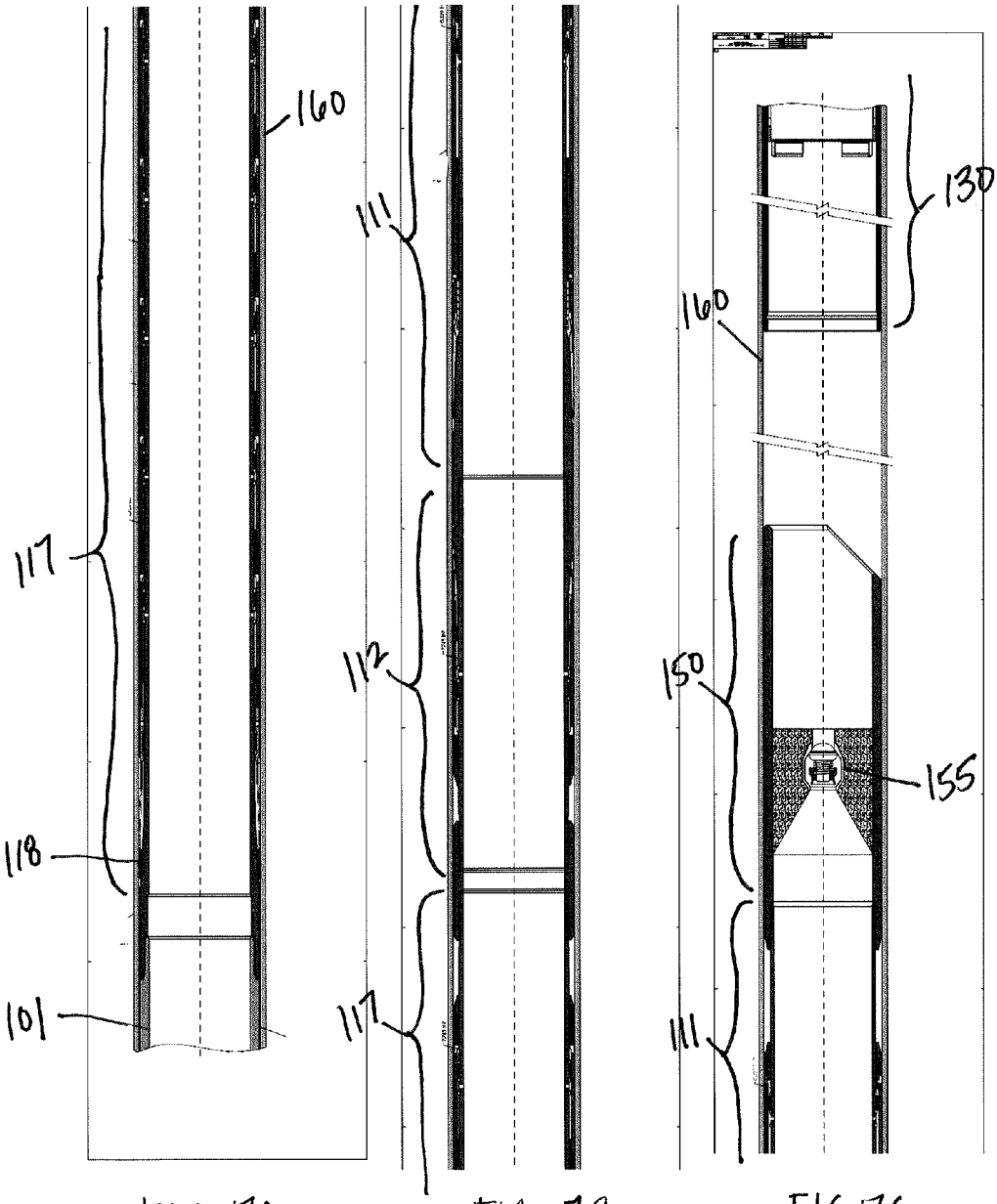

Referring now to FIGS. 7A-7C, FIGS. 7A-7C illustrate how the packer seal assembly 117 and packer seal 118 between the HTSA 100 and the host casing 160 may be set. The tieback string 101 may be pressurized to a set pressure, for example 3000 psi. This pressurization may start the packer setting process. The pressure may then be slowly increased to a final pressure, for example 5000 psi, to complete the packer setting process. The packer seal 118 of the packer seal assembly 117 is now set within the host casing 160, above the liner hanger system 130.

Figure 8:
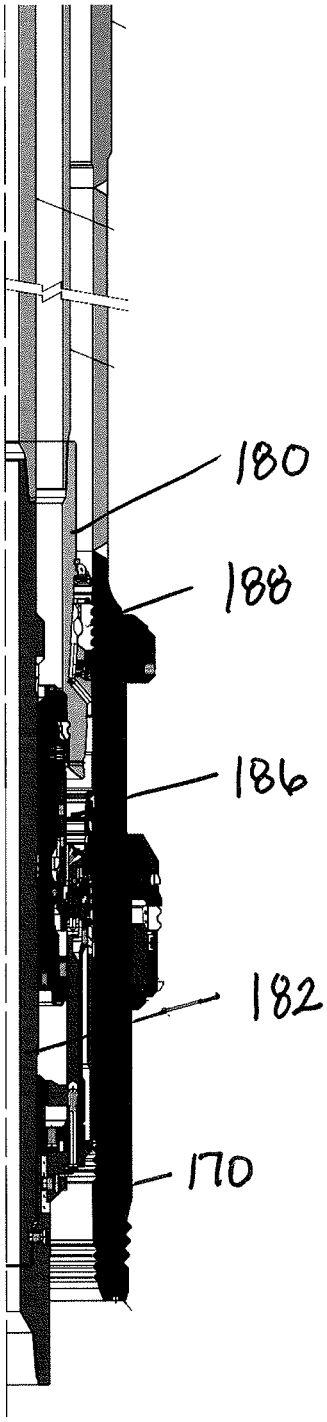

Referring now to FIG. 8, FIG. 8 depicts the casing hanger running tool 182 and casing hanger 180 landed in the well head 170. This is the same position before and after the HTSA 100 is set and sealed. The HTSA 100 seal may be tested at this time. The HTSA 100 may be tested down the annulus between the host casing 160 and the tieback string 101. Although certain exemplary method steps are disclosed as suitable for testing the HTSA 100, as would be appreciated by those of ordinary skill in the art having the benefit of the present disclosure, any other suitable methods may be used without departing from the scope of the present disclosure.

Figure 9:
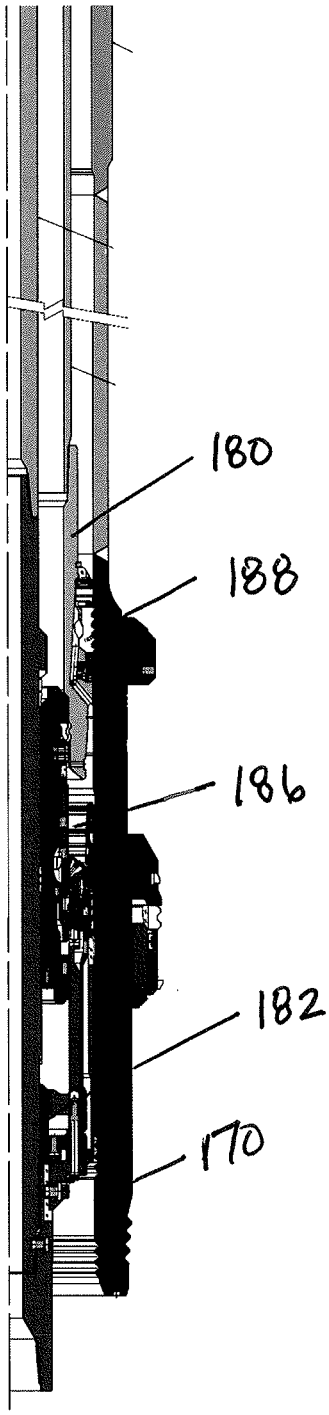
Figure 10:
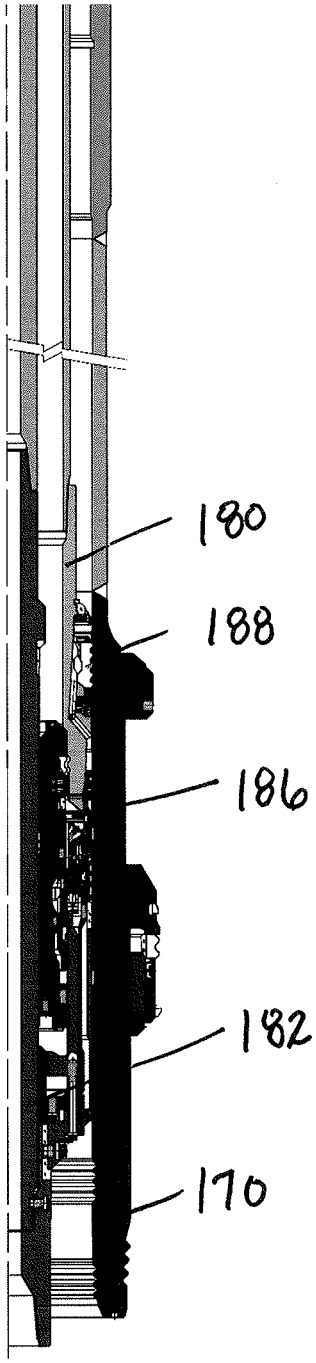
Figure 11:
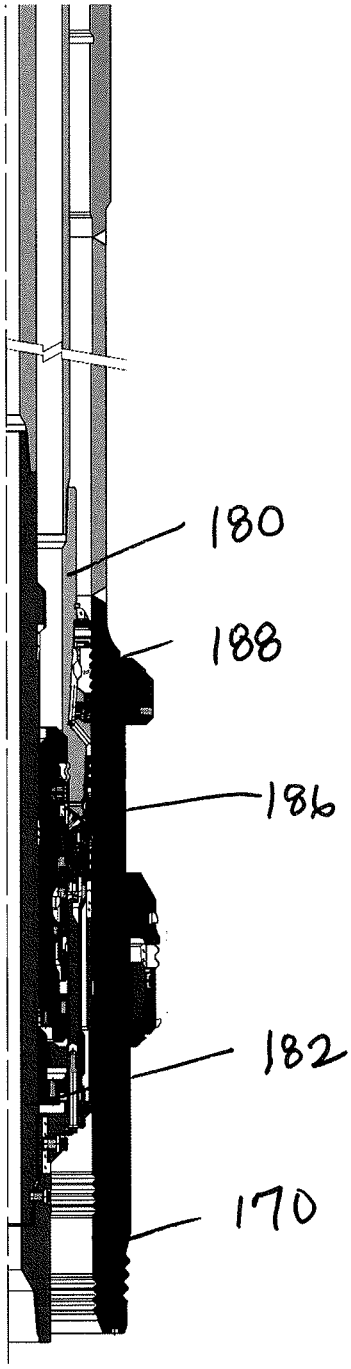

Referring now to FIGS. 9-11, FIGS. 9-11 depict how the tieback may be completed by sealing, locking, and testing the casing hanger 180 and casing hanger seal 186. The casing hanger lock ring 188 may be set and the casing hanger seal 186 may be set and tested. A drilling bottom hole assembly (not shown) may then be run in the hole to drill out the inverted float collar 150. FIG. 9 depicts how the casing hanger running tool 182 may be unlocked from the casing hanger 180. FIG. 10 depicts how the casing hanger seal 186 for the casing hanger 180 is mechanically loaded, but has not been fully set by pressure assist. FIG. 11 depicts how pressure may be applied to fully set the casing hanger seal 186 and lock the seal into the well head 170. The casing hanger seal 186 may then be tested. Although certain exemplary method steps are disclosed as suitable for setting, locking, and testing the casing hanger 180, as would be appreciated by those of ordinary skill in the art having the benefit of the present disclosure, any other suitable methods may be used without departing from the scope of the present disclosure.

As would be appreciated by those of ordinary skill in the art, with the benefit of this disclosure, in certain implementations, due to the configuration of the HTSA 100 and the liner hanger system 130, the casing hanger 180 may be landed without any special considerations or allowances for the position of the HTSA 100 within the host casing 160 or the liner hanger system 130. Specifically, the casing hanger 180 may be landed regardless of the position of the HTSA 100 within the host casing 160 or the liner hanger system 130. The system further eliminates the need for slack off weight or slack off distance to set the HTSA 100 in part due to the ability to the set within the host casing 160 or the liner hanger system 130 and the utilization of a pressure differential created in the tieback string 101 to set the HTSA 100.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A hybrid-tieback seal assembly system comprising:

a hybrid tieback seal assembly attached to a casing string, comprising a tieback string;

one or more anchoring bodies coupled to the tieback string;

one or more packer seal assemblies coupled to the tieback string proximate the one or more anchoring bodies; and a device for creating a pressure differential in the tieback string; and an applied pressure differential used for setting the one or more anchoring bodies and the one or more packer seal assemblies, said applied pressure differential being the sole means for setting said one or more anchoring bodies and one or more packer seal assemblies.

2. The system of claim 1, wherein the device for creating a pressure differential in the tieback string is an inverted float collar positioned within the tieback string, and wherein the inverted float collar comprises a valve.

3. The system of claim 1, wherein the device creating a pressure differential in the tieback string is a downhole ball seat positioned within the tieback string, wherein a ball is dropped from the surface and landed on the ball seat.

4. The system of claim 1, wherein the one or more packer seal assemblies comprise a packer seal and wherein the packer seal is a metal to metal packer seal.

5. The system of claim 1, wherein the one or more anchoring bodies are selected from a group consisting of a hold up body and a hold down body.

6. A method to tie a well back to the surface or subsea well head comprising:

running a hybrid-tieback seal assembly on a casing string into a wellbore, the hybrid-tieback seal assembly comprising one or more anchoring bodies, one or more packer seal assemblies, and a device for creating a pressure differential in a tieback string;

creating pressure in the tieback string;

setting the anchoring bodies within at least one of a section of casing, section of liner, or liner hanger system solely using the pressure created in the tieback string; and setting the one or more packer seal assemblies within at least one of a section of casing, section of liner, or liner hanger system solely using the pressure created in the tieback string.

7. The method of claim 6, further comprising the steps of setting, locking, and testing the casing hanger.

8. The method of claim 6, wherein a liner top of the liner hanger system remains pressure balanced once the hybrid-tieback seal assembly is fully set and locked.

9. The method of claim 6, wherein the device for creating a pressure differential in the tieback string is an inverted float collar positioned within the tieback string, and wherein the inverted float collar comprises a valve.

10. The method of claim 6, wherein the one or more packer seal assemblies comprise a packer seal and wherein the packer seal is a metal to metal packer seal.

11. The method of claim 6, wherein the one or more anchoring bodies are selected from a group consisting of a hold up body and a hold down body.

12. The method of claim 6, further comprising locating the hybrid-tieback seal assembly within at least one of the liner hanger system and the host casing.

13. A method to tie a well back to the surface or subsea well head comprising:

running a hybrid-tieback seal assembly on a casing string into a wellbore, the hybrid-tieback seal assembly comprising one or more anchoring bodies, one or more packer seal assemblies, and an inverted float collar positioned within a tieback string, wherein the tieback string is coupled to the hybrid-tieback seal assembly;

simultaneously allowing fluid from the well to enter the tieback string;

creating a pressure in the tieback string to set the one or more anchoring bodies and one or more packer seal assemblies within at least one of a section of casing, section of liner, or liner hanger system, wherein the one or more anchoring bodies and the one or more packer seal assemblies are set solely using the pressure created in the tieback string; and testing the hybrid-tieback seal assembly down an annulus between the host casing and the tieback string.

14. The method of claim 13, further comprising the steps of setting, locking, and testing casing hanger.

15. The method of claim 13, wherein a liner top of the liner hanger system remains pressure balanced once the hybrid-tieback seal assembly is fully set and locked.

16. The method of claim 13, wherein the one or more packer seal assemblies comprise a packer seal and wherein the packer seal is a metal to metal packer seal.

17. The method of claim 13, wherein the one or more anchoring bodies are selected from a group consisting of a hold up body and a hold down body.

18. The method of claim 13, further comprising locating the hybrid-tieback seal assembly within at least one of the liner hanger system and host casing.

* * * * *